United States Patent [19]

Nagao

[11] 4,122,418

[45] Oct. 24, 1978

[54] COMPOSITE RESONATOR

[76] Inventor: Tsukasa Nagao, 4-75,, Mabori, Yokosuka-shi, Kanagawa-ken, Japan

[21] Appl. No.: 683,143

[22] Filed: May 4, 1976

[30] Foreign Application Priority Data

Apr. 19, 1976 [JP] Japan ..... 51-44760

[51] Int. Cl.[2] ..... H01P 7/00; H01P 1/34

[52] U.S. Cl. ..... 333/82 R; 333/1.1; 333/24.1

[58] Field of Search ..... 333/1.1, 24.2, 73 S, 333/82 R, 82 B, 24.1

[56] References Cited

U.S. PATENT DOCUMENTS

| | | | |
|---|---|---|---|
| 3,350,663 | 10/1967 | Siekanowicz et al. | 333/1.1 |
| 3,350,664 | 10/1967 | Pistilli et al. | 333/1.1 |
| 3,355,679 | 11/1967 | Carr | 333/1.1 |
| 3,422,375 | 1/1969 | Omori | 333/1.1 |
| 3,714,608 | 1/1973 | Barnes et al. | 333/1.1 |
| 3,851,279 | 11/1974 | Andrikian | 333/1.1 |

*Primary Examiner*—Paul L. Gensler

*Attorney, Agent, or Firm*—Ladas, Parry, Von Gehr, Goldsmith & Deschamps

[57] ABSTRACT

A composite resonator according to the invention is made of a combination of ferrite and dielectric, a combination of ferrite, dielectric and conductor or a combination of ferrite and conductor.

8 Claims, 37 Drawing Figures

COMPOSITE RESONATOR

Theoretical analysis of the operation of a circulator employing a composite of ferrite and dielectric has led to an experimentally verified finding that there are plural operating points satisfying two conditions for perfect circulation. Existence of the plural operating points has been found also in a ferrite-conductor composite and in a ferrite-dielectric-conductor composite. In the above-mentioned composites, coexistence of a normal mode and a subsidiary mode and operating points related thereto have been found where the ferrite in the composite is made of plural portions having different saturation magnetizations and this phenomenon can be utilized for broadbanding the circulator embodiment. Broadbanding of the circulator is best effected by making constant the anisotropic splitting factor $\kappa/\mu$ of the plural ferrite portions.

The composite resonator may also be utilized for an isolator, a phase-shifter and other microwave circuits performing a multiple frequency operation, a multiple direction operation or a switching operation between a multiple frequency operation and a multiple direction operation.

The present invention relates to a composite resonator in which ferrite is utilized.

A resonator using ferrite and devices to which such a resonator is applied are generally useful and have been widely used as indispensable nonreciprocal elements in microwave circuitry. They are in principle based on unique ferromagnetic resonance phenomena that is theoretically represented by an asymmetric permeability tensor. Among the applied devices, there are circulators, isolators, filters, phase-shifters and still others. They are based on resonances of the ferrite resonator under a uniform biasing magnetic field applied externally.

For instance, in a circulator incorporating an ordinary ferrite disk as a core resonator, circulator frequency characteristics are mostly featured by a single peak of isolation, so that the frequency band is very narrow. Many people have been engaged in improving such circulator characteristics. Major efforts have been made to broaden the frequency band by externally appending sophisticated broadbanding transformers or impedance matching networks to the circulator.

Moreover, regarding isolators, filters, phase-shifters and other applied devices, the resonance characteristics of a single ferrite resonator of a given saturation magnetization under a uniform magnetic field are utilized. One can say that if any progress has been made to improve their frequency characteristic, it has been through the use of externally appended circuitry.

Little effort has apparently been made to improve the resonator itself and still less attention has been given to a composite resonator. It is partly because theoretical and experimental treatment of the composite and its resonator were difficult and unattractive, and it is hard to determine the most appropriate conditions of theoretical operations. It is therefore an object of the present invention to provide an improved resonator which is based on the concept making use of the resonance characteristics of a composite resonator under either a uniform magnetic field or a nonuniform magnetic field.

A detailed explanation will now be made of the composite resonator according to the invention and its application to a stripline Y-junction circulator with reference to the accompanying drawings in which.

Figure 12:
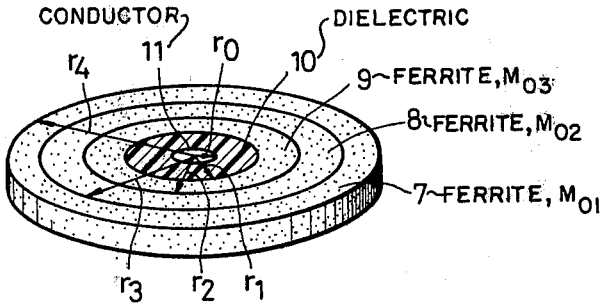
FIG. 12 is a perspective view showing another example of the composite resonator according to the invention.
Figure 16A:
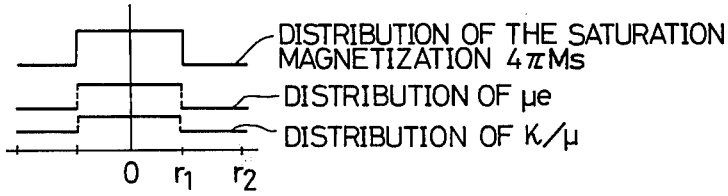
Figure 16B:
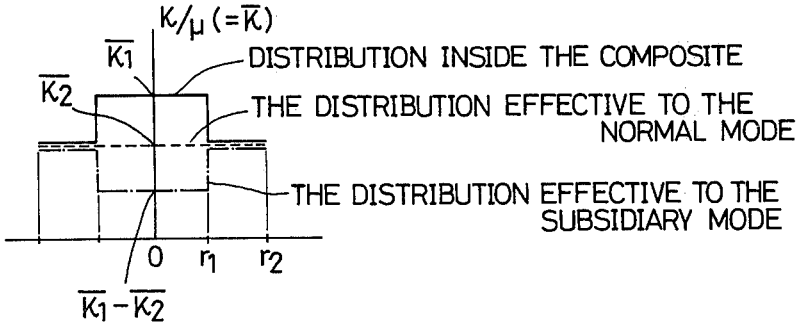
Figure 17:
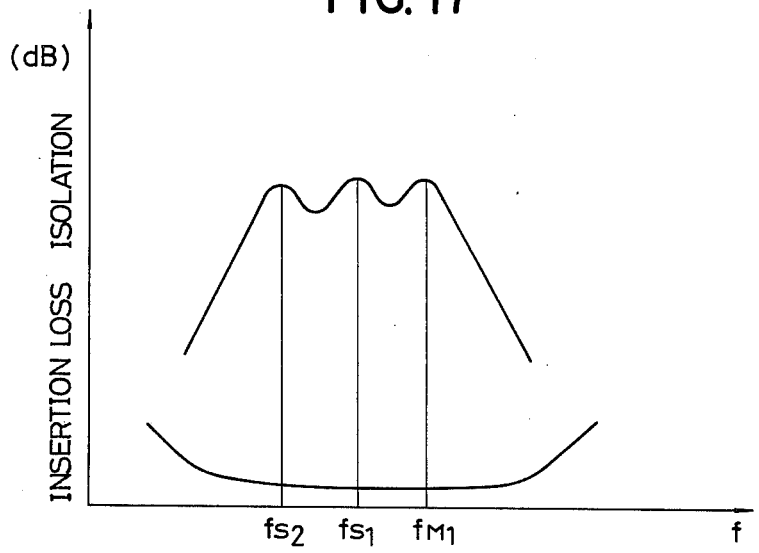
Figure 18:
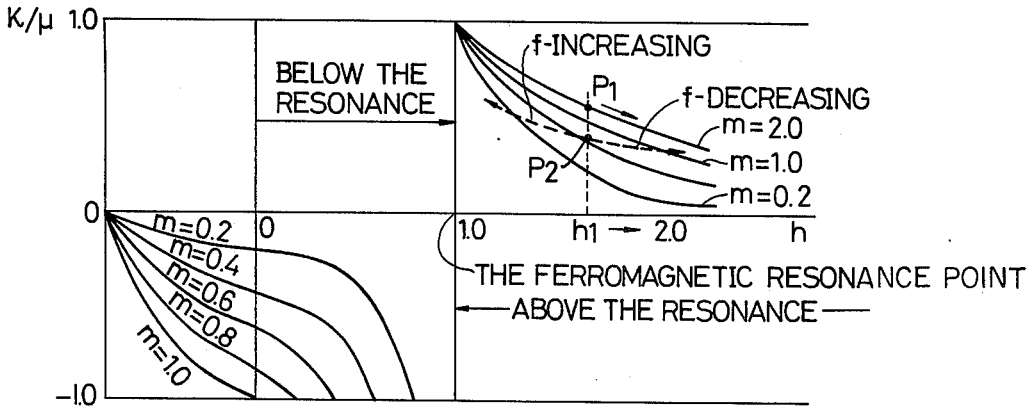
Figure 19:
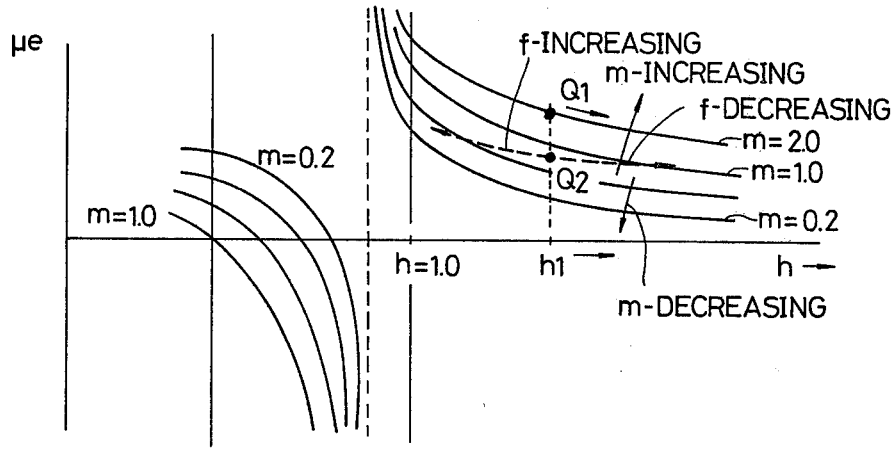
Figure 20:
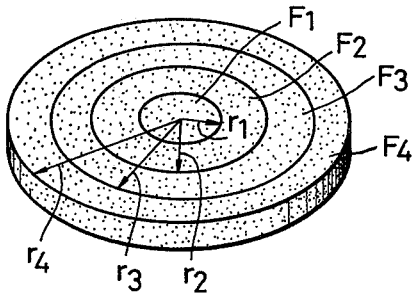
Figure 21:
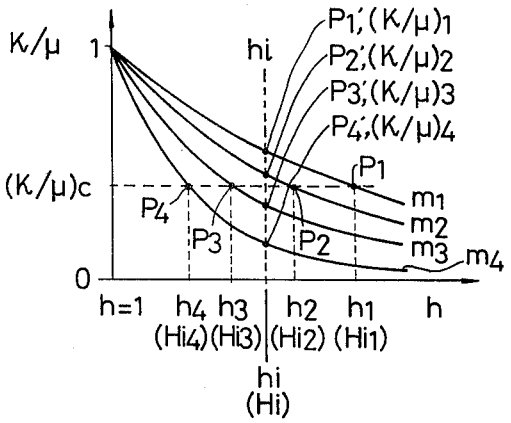
Figure 22:
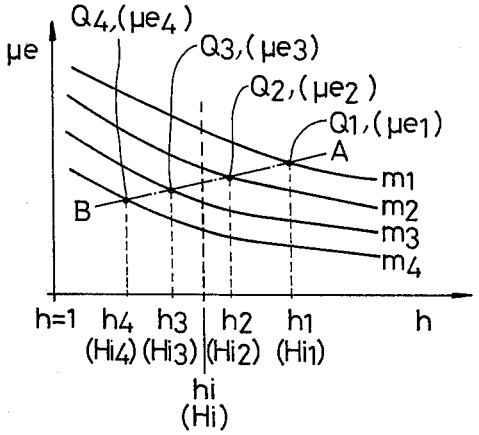
Figure 23:
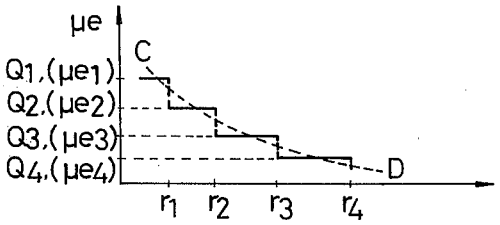
Figure 24:
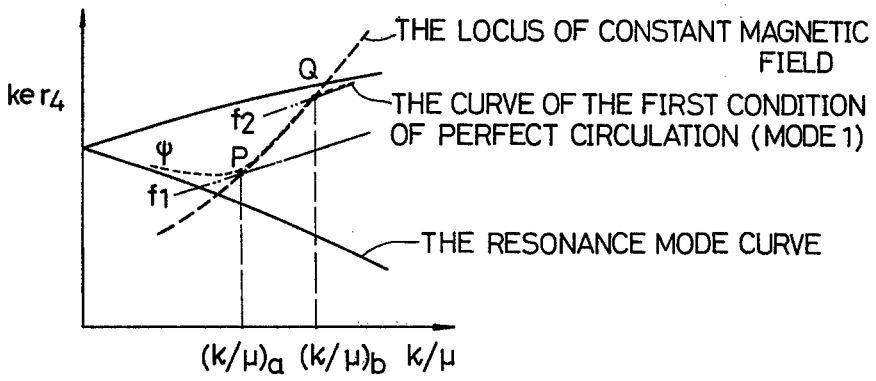
Figure 25:
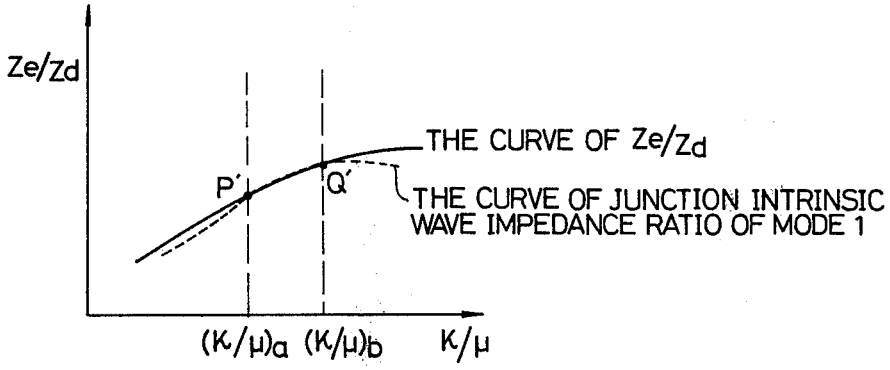
Figure 26:
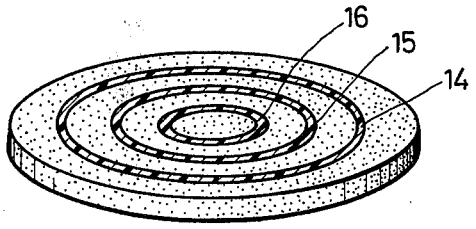

FIGS. 16(a) and 16(b) are graphical diagrams for explaining the existence of the subsidiary mode;

FIG. 17 is a graphical diagram showing the operation of a circulator incorporating the resonator shown in FIG. 12;

FIGS. 18 and 19 are graphical diagrams showing the relationship between states of resonance of the ferrite and the magnetic field;

FIG. 20 is a perspective view showing an example of a multi-layer ferrite composite;

FIGS. 21, 22 and 23 are graphical diagrams showing states in which a nonuniform magnetic field is applied to the multi-layer ferrtie composite of FIG. 20 to obtain a constant $\kappa/\mu$ value;

FIGS. 24 and 25 are graphical diagrams showing the operation of a circulator incorporating the composite shown in FIG. 20;

FIG. 26 is a perspective view showing still another example of the composite resonator according to the invention;

FIGS. 27(a), 27(b), 27(c) and 27(d) are schematic diagrams showing the operation of a double circulation frequency operation circulator and a double circulation direction operation circulator; and FIGS. 28(a), 28(b), 28(c) and 28(d) are circuit diagrams schematically showing examples of circuits employing circulators to which the composite resonator according to the invention is applied.

Figure 29:
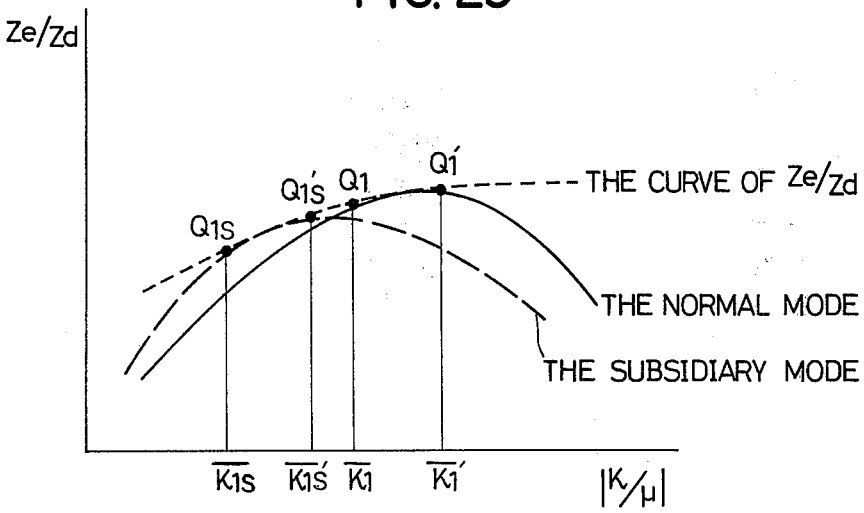

FIG. 29 is a graphical diagram showing the operation of a circulator incorporating the composite shown in FIG. 20.

The present composite and the resonator made therefrom are not applicable solely to a circulator but wide and various applications are contemplated. The present invention provides a composite resonator having the potential of multiple circulation frequency operation, double or multiple circulation direction operation, broadbanding operation, internal impedance matching mechanism, switching operation and bandshifting, for instance.

Assuming now that the external DC magnetic field is uniform, a case will be described in which the composite ferrite resonator is loaded in a stripline Y-junction and then the resulting stripline Y-junction circulator is operated under such magnetic field. A sketch of the stripline Y-junction circulator using a resonator of a ferrite-conductor composite is given in FIGS. 1(a) and 1(b). The composite resonator in this case is made by combining a ferrite ring 2 and a metallic conductor puck 1. The device is assembled from a pair of such composite resonators 1, 1' and 2, 2', a Y-junction 3 with three ports $T_1$, $T_2$ and $T_3$, and a pair of grounded planes (not shown) which cover upper and lower sides of the device. The resulting stripline has a thickness $t$ and width $w$ subtending an angle $2\Psi$ on the center conductor. It is actually adapted to operate as a circulator under the DC magnetic field applied in the direction shown by an arrow A in FIG. 1(a).

Before entering into an exact analysis and explanation of the circulator action of the device to which the ferrite-conductor composite is applied as the resonator, it will be convenient to make a theoretical analysis of the circulator action of a device in which a ferrite-dielectric composite is used (the conductor of the composite being replaced by a dielectric) and, most importantly, to demonstrate experimental results which verify the theoretical analysis. Analysis of the circulator loaded with the ferrite-dielectric composite (which is denoted hereinafter as the ferrite-dielectric-composite circulator) is not only helpful towards understanding the circulator-action of the ferrite-conductor-composite circulator, but also instructive to understand the circulator-action of a ferrite-dielectric-conductor-composite circulator that is described hereinafter.

The ferrite-dielectric composite has a ferrite ring of inner and outer radii $r_1$ and $r_2$, and a dielectric puck of radius $r_1$, with a very small thickness. One can easily obtain electromagnetic fields inside the composite by solving simple boundary value problems for the two media composite, assuming that it is thin enough. Taking $E_2(r, \theta)$ for the electric field inside the composite, one can describe the electric field at the periphery $r = r_2$ of the composite as follows:

$$E_z(r_2, \theta) = \sum_{n=-\infty}^{\infty} b_n F_n(x_3) e^{-jn\theta}, \tag{1}$$

$$\text{and } F_n(x_3) = J_n(x_3) + C_n Y_n(x_3), \tag{2}$$

where $$C_n = -\frac{J_n'(x_2) - J_n(x_2)D_n}{Y_n'(x_2) - Y_n(x_2)D_n},$$

$$D_n = \eta_{12}\frac{J_n'(x_1)}{J_n(x_1)} + \frac{\kappa}{\mu}\frac{n}{x_2},$$

$$\eta_{12} = \sqrt{\frac{\epsilon_{e1}\mu_{e2}}{\epsilon_{e2}}},$$

$$x_3 = k_{e2}r_2,\ x_2 = k_{e2}r_1,\ x_1 = k_{e1}r_1,$$

$$k_{e2} = \omega\sqrt{\epsilon_0\mu_0\epsilon_{e2}\mu_{e2}},$$

$$k_{e1} = \omega\sqrt{\epsilon_0\mu_0\epsilon_{e1}},$$

$J_n$, $Y_n$ Bessel functions of the first and second kinds, respectively, and "'" denotes the derivative with respect to its argument in the bracket;

$\epsilon_{el}$ specific permittivity of the dielectric;

$\mu$, $\kappa$ elements of the specific permeability tensor of the ferrite;

$\epsilon_{e2}$, $\mu_{e2}$ specific permittivity and specific effective permeability of the ferrite;

$r_1$, $r_2$ inner and outer radii of the ferrite ring, respectively, and the inner radius of the ferrite is equal to the radius of the dielectric puck.

Hereupon, the anaylsis proceeds with the notations of $F_n$ and $F_n'$ given by Eq. 2.

It is generally known at the first stage of design that any Y-junction must satisfy circulation requirements to act as a circulator. They are given by solving the equality relations between three junction impedances of the Y-junction and corresponding impedance representations derived from the eigenvalues of the scattering matrix regarding the same Y-junction. The three junction impedances are, namely, $Z^{(0)}$ for the non-rotating mode, $Z^{(+)}$ for the forward rotating mode and $Z^{(-)}$ for the backward rotating mode. They hold three equality relations as follows $$Z^{(0)} = j\sqrt{3}\frac{\psi}{\pi}Z_e h_0 = -jZ_d\cot\frac{\theta}{2}, \tag{3}$$

$$Z^{(+)} = j\sqrt{3}\frac{\psi}{\pi}Z_e h_1 = -jZ_d\cot\left(\frac{\theta}{2} - \frac{\pi}{3}\right),$$

$$Z^{(-)} = j\sqrt{3}\frac{\psi}{\pi}Z_e h_2 = -jZ_d\cot\left(\frac{\theta}{2} + \frac{\pi}{3}\right),$$

where $$h_0 = \sum_{m=0}^{2}\frac{\sin 3m\psi}{3m\psi}\ \frac{2f_{3ma}}{f_{3ma}^2 - (g_{3m} - f_{3ms})^2}, \tag{4}$$

$$h_1 = \sum_{m=-2}^{1}\frac{\sin(3m+1)\psi}{(3m+1)\psi}\ \frac{1}{f_{3m+1} - g_{3m+1}},$$

$$h_2 = \sum_{m=-1}^{2}\frac{\sin(3m-1)\psi}{(3m-1)\psi}\ \frac{1}{f_{3m-1} - g_{3m-1}},$$

$$f_n = \frac{F_n'(x_3)}{F_n(x_3)}, \text{(for all } n = 3m-1, 3m, 3m+1), \tag{5}$$

$$g_n = \frac{\kappa}{\mu}\frac{n}{x_3},$$

$$f_{na} = \frac{(f_n + f_{-n})}{2},\ f_{ns} = \frac{(f_n - f_{-n})}{2}.$$

There are the junction intrinsic wave impedance $Z_e$ given by $$Z_e = \sqrt{\frac{\mu_0\mu_{e2}}{\epsilon_0\epsilon_{e2}}} \tag{6}$$

and the wave impedance $Z_d$ of the stripline on the boundary connected to the junction given by $$Z_d = \frac{w}{4\pi r_2}\sqrt{\frac{\mu_0\mu_{ed}}{\epsilon_0\epsilon_d}}\log\left(\frac{w+h}{w+t}\right), \tag{7}$$

where $\Psi$ is half the angle subtended by the stripline width w on the center conductor, $t$ the thickness of the center conductor of the stripline, $h$ the distance between the grounded conductors covering the device. $\epsilon_d$ and $\mu_{ed}$ are specific permittivity and specific effective permeability of the medium filled in the stripline.

From Eq. (3), one can derive the following equations $$(h_0 + h_1 + h_2)(H_0h_1 + h_1h_2 + h_2h_0) - 9h_0h_1h_2 = 0, \quad (8)$$

$$\frac{Z_e}{Z_d} = \frac{\pi}{\psi} \frac{h_1 - h_2}{2h_1h_2 - h_0(h_1 + h_2)}. \quad (9)$$

They are respectively called the first and the second condition equations of perfect circulation. The Y-junction must satisfy them.

Figure 2:
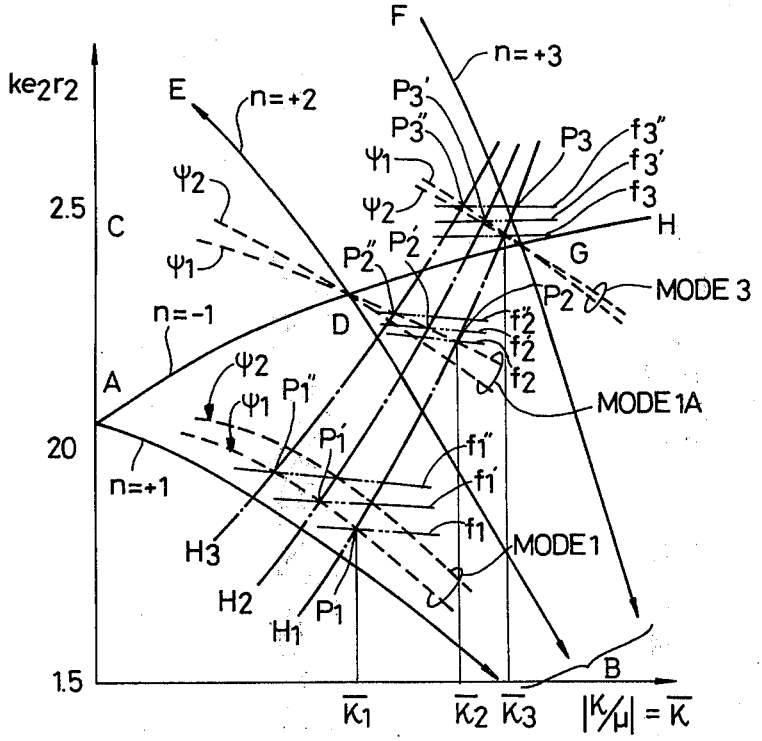
FIGS. 2 and 3 are graphical diagrams showing the operation of a circulator incorporating a ferrite-dielectric composite.

FIG. 2 shows results (dashed lines) of computation of Eq. (8) on which resonant mode curves (solid lines) are superimposed. It is reasonable to think that the circulator-action is almost characterized by the first circulation condition curves. In fact, the circulator-actions are theoretically traced on the first circulation curves in contrast with the resonant mode curves. In FIG. 2, there are some resonant mode curves drawn. "+" and "−" denote the clockwise and counterclockwise rotating modes, respectively. A number after the sign is the order of the resonant mode.

The saturation magnetization $4\pi M_s$ of the ferrite in the composite being given, one can draw additionally loci of both constant internal magnetic field intensity $H_1$, $H_2$ and $H_3$ (dot and dash) and constant circulation frequency $f_1$, $f_2$ and $f_3$ (double dot and dash).

Now, one can define the perfect circulation mode distinctly with the resonant mode curves. Mode 1 is defined in the region ADB bounded by the resonant mode curves $n=+1$, $-1$ and $+2$, mode 1A in the sectors ADE, BDG made by the resonant mode curves $n=-1$ and $+2$, and mode 3 mostly in the sector DGF bounded by the resonance curves $n=-1$ and $+3$. These circulation mode curves depend on $\Psi$ half the angle for the stripline width, and other factors.

Assume that the angle $\Psi_1$ is given. If the internal magnetic field is increased from $H_1$ to $H_3$, the circulator-action is representated by an operating point of perfect circulation which is correctly traced along a circulation mode curve as denoted by $P_1$, $P_1'$ and $P_1''$ on the curve of mode 1. Then, one can read corresponding circulation frequencies $f_1$, $f_1'$ and $f_1''$. similarly, as the internal magnetic field increases from $H_1$ to $H_3$, one can find respective operating points $P_2$, $P_2'$ and $P_2''$ on the curve of mode 1A, with the circulation frequencies $f_2$, $f_2'$ and $f_2''$. Moreover, operating points $P_3$, $P_3'$ and $P_3''$ can be found on the curve of mode 3 near the cross point G of the resonant mode curves $n=-1$ and $+3$, with the circulation frequencies $f_3$, $f_3'$ and $f_3''$, respectively. It is important that these operating points at their frequencies are found on each locus of constant internal magnetic field intensity. Therefore, a triple circulation frequency operation is practically realizable.

Figure 3:
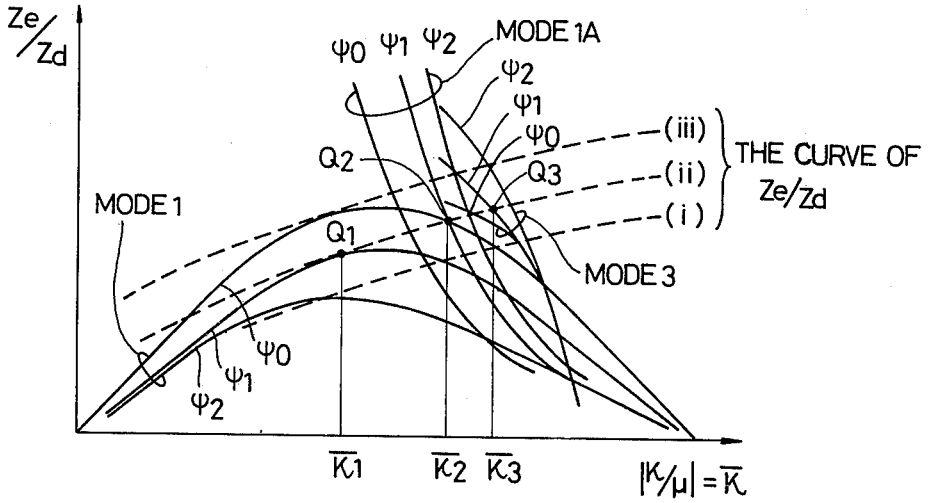

To complete the perfect circulation, the Y-junction must satisfy the second circulation condition in addition to the first circulation condition. In FIG. 3, the results of computation of the right term of Eq. (9) and of the ratio of the junction intrinsic impedance $Z_e$ to the wave impedance $Z_d$ of coupled striplines are drawn together. The relationships (i), (ii) and (iii) between the junction intrinsic wave impedance ration $Z_e/Z_d$ and the ferrite anisotropic splitting factor $\kappa/\mu$ are shown with respect to specific permittivities $\epsilon_d'$, $\epsilon_d''$ and $\epsilon_d'''$ ($\epsilon_d' < \epsilon_d'' < \epsilon_d'''$) of Eq. (6). The computed results of Eq. (9) dependent upon $\Psi$ half the angle of the coupled striplines are shown by a bundle of curves for each circulation mode.

It is important to note from FIG. 3 that the intersection of each $Z_e/Z_d$ curve and each mode curve of the computed results of Eq. (9) completely satisfies the second circulation condition. In order to achieve perfect circulation, the intersections $P_1$, $P_2$ and $P_3$ in the $k_{e2}r_2$ versus $\kappa/\mu$ relationship of the first circulation condition must coincide with the intersections $Q_1$, $Q_2$ and $Q_3$, respectively, in the $Z_e/Z_d$ versus $\kappa/\mu$ relationship of the second circulation condition. If they coincide with each other in the $\kappa/\mu$ value, then those pairs ($P_1$, $Q_1$), $P_2$, $Q_2$) and ($P_3$, $Q_3$) provide the desired operating points for perfect circulation. These are called circulation adjustments. Contrarily, if they do not, one can usually make each pair of them coincide in its $\kappa/\mu$ value by adjusting such factors as dielectric permittivity $\epsilon_d$ and a half angle $\Psi$ of the coupled striplines. From these circulation adjustments for perfect circulation, one can deduce the knowledge and criteria necessary for the specifications of the composite resonators and for the circulation adjustments of the composite Y-junction.

The input impedance of the Y-junction becomes equal to the wave impedance of the coupled stripline when the circulation adjustments are completely achieved.

Now that the Y-junction can perform perfect circulation at the predicted point $P_1$, $P_2$ and $P_3$ with the frequencies $f_1$, $f_2$ and $f_3$, respectively, under an internal magnetic field $H_1$, the triple circulation frequency operation takes place.

Figure 1:
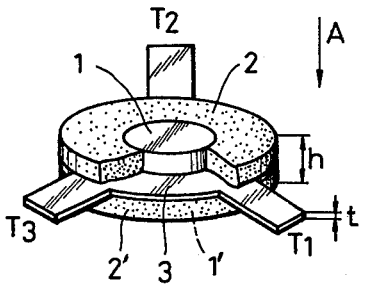
FIG. 1(a) is a perspective view showing an example of application of the composite resonator according to the invention to a circulator.
FIG. 1(b) is a plane view of the example shown in FIG. 1(a)
Figure 1:
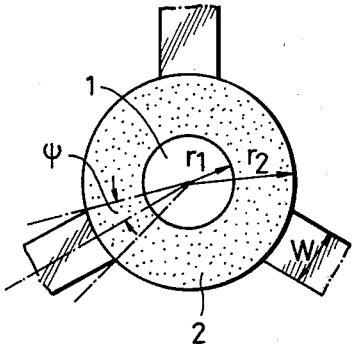
Figure 4:
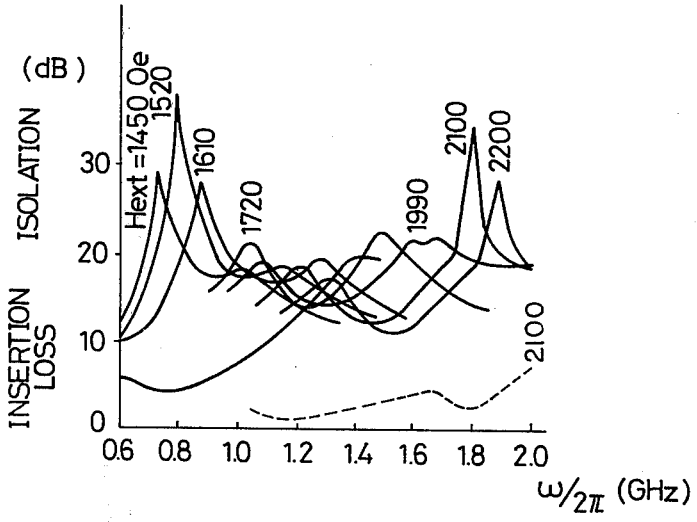
FIGS. 4 and 5 are graphical diagrams showing experimental results of the operation of the circulator incorporating the ferrite-dielectric composite.
Figure 5:
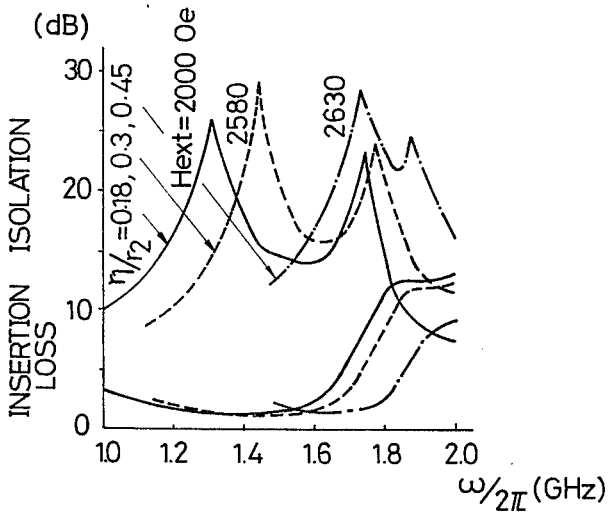

The experimental examples are now demonstrated in FIGS. 4 and 5. The ferrite material used is of A1-YIG whose saturation magnetization $4\pi M_s = 950$ Gauss and specific permittivity $\epsilon_{e2} = 14$. The dielectric puck is replaced with air. The geometry of the ferrite ring is such that the outer radius $r_2 = 10$ mm, the ratio $r_1/r_2 = 0.2$ and the thickness is 2.5 mm. The configuration of the Y-junction circulator is shown in FIG. 1.

The measured results are shown in FIG. 4 by solid lines for isolation and by dashed lines for insertion losses. Measurements are made in accordance with sequential variation of the external magnetic field intensity. When the external magnetic field is low, the characteristics are featured by two peaks of isolation, one sharp peak at low frequency and one dull peak at high frequency. When the magnetic field is increased, those peaks become level with each other. When the magnetic field is increased still further, the peak at high frequency becomes the highest, and the two peaks are close in distance. One of the minimum insertion losses occurs at the same frequency as the second peak.

One can understand, from his knowledge of the circulation modes, that the low frequency peak signifies an operation of mode 1 and the two peaks at high frequency signify operations of mode 1A and mode 3.

FIG. 5 shows a comparison of the circulation characteristics obtained with a variation of the ratio $r_1/r_2$. Double peaks of isolation are observed to come close to each other as the ratio $r_1/r_2$ increases.

One can now conclude from the theoretical and experimental results that a circulator loaded with the ferrite-dielectric composites can operate at several circulation frequencies and that the theoretical analysis of the circulator agrees with the experimental results.

As is well known, a circulator loaded with disk ferrites (hereafter referred to as a disk-ferrite circulator) has long and widely been used, in which only mode 1 of perfect circulation plays the central role. Even though mode 1A and others exist, they do not provide any useful design data. Therefore, the possiblity of multiple operation with higher order modes has not received much attention.

Now, owing to the present invention, a double or a triple circulation frequency operation is realizable. It is further mentioned that circulation adjustments are performed by adjusting several factors, such as stripline width, specific permittivity of a dielectric surrounding the ferrite, and internal magnetic field intensity. A separation between the double circulation frequencies is dependent on the ratio $r_1/r_2$ of the composite. One can foresee that, as the input impedance of a circulator for a double or multiple circulation frequency operation usually has a lower value than the wave impedance of a commercially available transmission line, advantageous applications of such circulators in microwave integrated circuits seem to be appreciable. Ferrite-conductor composites and circulators incorporating them will now be discussed.

A circulator using a ferrite-conductor composite provides another useful feature as a mode of multiple circulation frequency operation. If one replaces the dielectric puck among the ferrite-dielectric composite with a conductor, then a ferrite-conductor composite can be made. I have found that a circulator loaded with this ferrite-conductor composite will operate as a diplexer if it is adequately adjusted. In fact, a modified-ferrite-dielectric-conductor-composite circulator to be described later operates such that it acts normally as a circulator at the first lowest circulation frequency, but does not act in the same direction at the second circulation frequency because it circulates in a direction opposite to that of the first circulation frequency operation. The sketch of the ferrite-conductor-composite circulator is shown in FIG. 1. One can easily understand the mechanism of the circulator loaded with the ferrite-conductor composite if he can distinguish its characteristics from those of the circulator loaded with the ferrite-dielectric composite.

Figure 6:
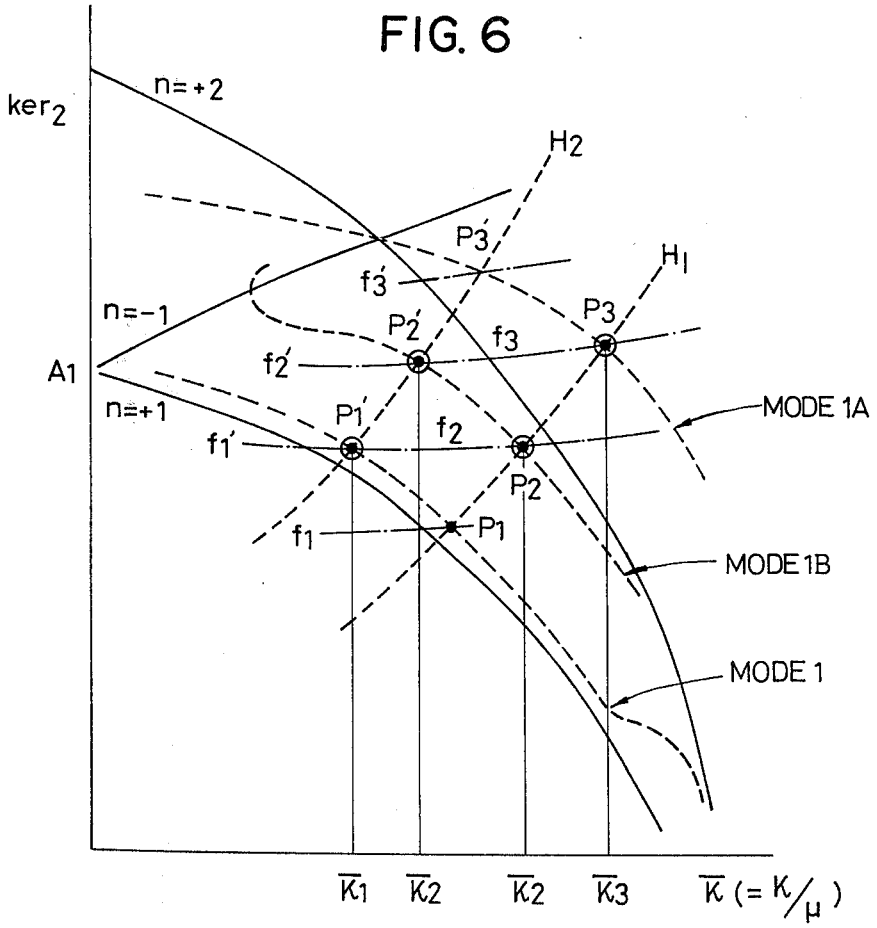
FIGS. 6, 7 and 8 are graphical diagrams showing the operation of a circulator incorporating a ferrite-conductor composite according to the invention.

Computed results of the first circulation condition, with respect to a small ratio of $r_1/r_2$, are shown in FIG. 6, with the resonant mode curves superimposed. As for the resonant mode, generally a pair of the resonant mode curves $n=+1$ and $-1$ shift upwards in the $k_e r_2$ versus $\kappa/\mu$ graph and they become almost straight if the ratio $r_1/r_2$ increaes. Other higher order mode curves move in the same way as those of $n=+1$ and $-1$ do. A remarkable fact is that there exists another mode 1B between mode 1 and mode 1A. Therefore, one can take advantage of those modes in circulator-action. For a given saturation magnetization, one can draw loci of both constant internal magnetic field intensity and constant circulation frequency in the $k_e r_2$ versus $\kappa/\mu$ graph and he can find operating points $P_1$, $P_2$ and $P_3$ at the circulation frequencies $f_1$, $f_2$ and $f_3$ for mode 1, mode 1B and mode 1A, respectively, on the constant internal magnetic field locus $H_1$. When the magnetic field is increased from $H_1$ to $H_2$, the operating points are moved along each mode curve to corresponding points $P_1'$, $P_2'$ and $P_3'$, respectively, at the frequencies $f_1'$, $f_2'$ and $f_3'$ on the internal magnetic field locus $H_2$.

Figure 7:
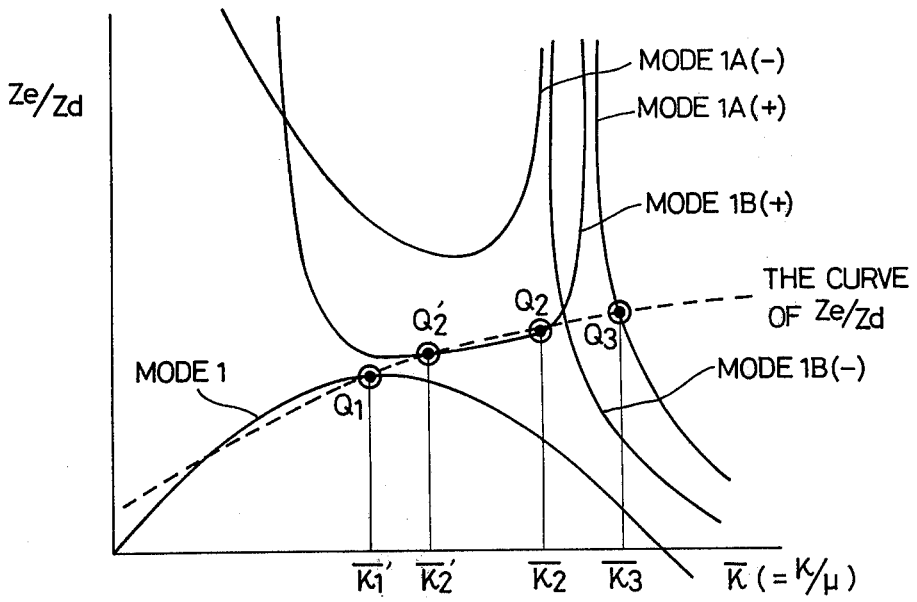

FIG. 7 shows results of the second circulation condition in a graph plotting the $Z_e/Z_d$ versus $\kappa/\mu$ relationship. There are curves of mode 1, mode 1B and mode 1A shown together with the curve of $Z_e/Z_d$. A sign in the bracket after the mode number denotes a circulation direction. The second circulation condition is completely satisfied when the curves of mode 1, mode 1B and mode 1A intersect the curve of $Z_e/Z_d$ at the desired points $Q_1$, $Q_2$ and $Q_3$ under the internal magnetic field $H_1$. The circulation adjustments are achieved when $P_1$, $P_2$ and $P_3$ coincide with $Q_1$, $Q_2$ and $Q_3$, respectively, in each $\kappa/\mu$ value under the internal magnetic field $H_1$. But only $P_1$ and its corresponding point $Q_1$ do not hold their circulation adjustments because the point $Q_1$ does not satisfy the second circulation condition. Similarly when the magnetic field is $H_2$, if each of these pairs ($P_1'$, $Q_1'$), ($P_2'$, $Q_2'$) and ($P_3'$, $Q_3'$) coincides in its $\kappa/\mu$value, they completely hold the circulation adjustments except the pair ($P_3'$, $Q_3'$). Mode 1 and mode 1B have the same direction at the points $Q_1'$ and $Q_2'$, but they have their own different directions at the points $Q_2$ and $Q_3$, so that as the magnetic field is switched from $H_2$ to $H_1$, only the direction of the lower circulation frequency is inverted when the two operations under the fields $H_1$ and $H_2$ have the same frequencies.

Figure 8:
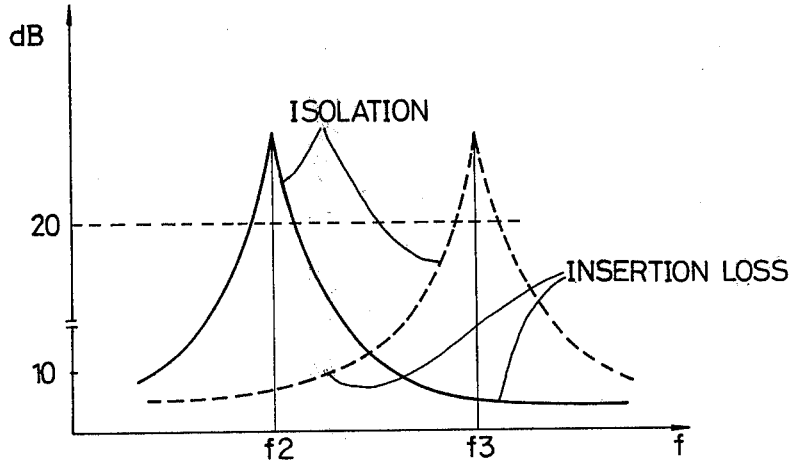

The circulator loaded with the ferrite-conductor composites operates along with mode 1B(−) and mode 1A(+) under the magnetic field $H_1$, while it operates with mode 1 and mode 1B(+) under the magnetic field $H_2$ just as well as the above-mentioned circulator loaded with ferrite-dielectric composites operates with mode 1 and mode 1A(+). FIG. 8 shows an experimental result of the circulator loaded with the ferrite-conductor composite under the magnetic field $H_1$. The solid line shows, at first, the isolation characteristics at the first circulation frequency $f_2$ and continues to the insertion loss curve at the second circulation frequency $f_3$, and the dashed line, vice versa due to the fact that the second circulation at frequency $f_2$ has a circulation direction opposite to that of the third circulation at frequency $f_3$.

For example, assume that signal waves of frequencies $f_2$ and $f_3$ are incident upon the port $T_1$ as shown in FIG. 1. Then, the signal wave $f_2$ normally comes out of port $T_2$ and reversely the signal wave $f_3$ comes out of port $T_3$. This circulator operates at two circulation frequencies with different directions. It provides another useful operation by its double circulation direction operation or diplexer operation, in contrast with a double circulation frequency operation.

When circulation adjustments are achieved under the magnetic flux intensity $H_1$, the circulator action is characterized by a second circulation frequency $f_2$ of a positive (counterclockwise) direction of circulation, and a third circulation frequency $f_3$ of a negative (clockwise) direction. Then, one can realize the double circulation frequency - double direction operation. When circulation adjustments are fulfilled under the magnetic field intensity $H_2$, the circulator action is characterized by the first circulation frequency $f_1'$ of the positive direction, the second circulation frequency $f_2'$ of the same positive direction. Then one can obtain the double circulation frequency operation. There, further higher order mode operation can be added if it be adequately adjusted.

The simplicity attendant to the application of the resonators to the circulator which are made by putting a conductor into a ferrite ring, the variety of ways in which the circulator acts for operations such as a double circulation frequency operation, a double direction operation, and a multiple circulation frequency operation in addition to double direction operations, and the consistency with which the theoretical treatments agree with the experimental results, they assure that there is no equal to this circulator.

Figure 9:
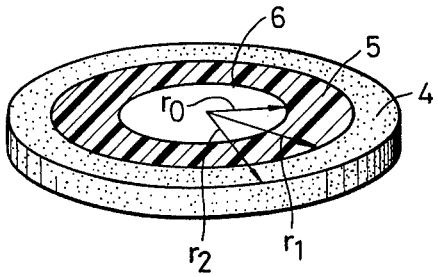
FIG. 9 is a perspective view showing an example of the composite resonator according to the invention.

Apart from the type of composites with two material components, such as the ferrite-dielectric composite and the ferrite-conductor composite, I shall now describe another composite having three material components, i.e., ferrite, dielectric and conductor. The configuration of this composite is shown in FIG. 9. The composite is made of three parts, i.e., a ferrite ring 4 of inner and outer radii $r_1$ and $r_2$, a dielectric ring 5 of inner and outer radii $r_0$ and $r_1$, and a conductor 6 of radius $r_0$. All of them are concentrically assembled in a single disk shape. Insertion of a conductor into the ferrite-dielectric composite produces the effect whereby a circulator-action is made to vary between a double (multiple) circulation frequency operation of the ferrite-dielectric-composite circulator and a triple circulation frequency - double circulation direction operation of a ferrite-conductor-composite circulator. It really depends on the ratio of $r_0/r_1$ and the length of the conductor. Of course, the dielectric portion is effective to moderate the effect of the conductor. By changing freely the ratio of $r_0/r_1$ and the length of the conductor in the composite, so as to suppress mode 1B, one can obtain desired data of mode 1, mode 1A and mode 3 from both the first and the second circulation conditions, and in some cases, without any impedance matching transformer, one can easily perform the circulator adjustments in addition to the circulation adjustments. In consequence, the input impedance of the circulator can be completely matched to the connected transmission lines.

If one can take a certain value of the ratio $r_0/r_1$ and a given length of the conductor so as to bring forth mode 1B's operation in addition to those of mode 1, mode 1A and mode 3, the circulator can be made to perform an intermediate operation between the double circulation frequency operation and the triple circulation frequency - double direction operation.

Figure 10:
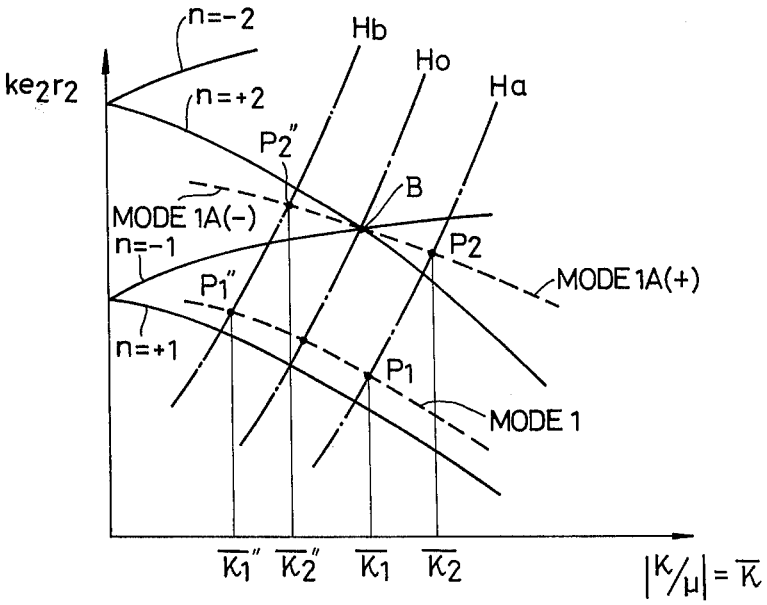
FIGS. 10 and 11 are graphical diagrams showing the operation of a circulator incorporating the composite shown in FIG. 9.
Figure 11:
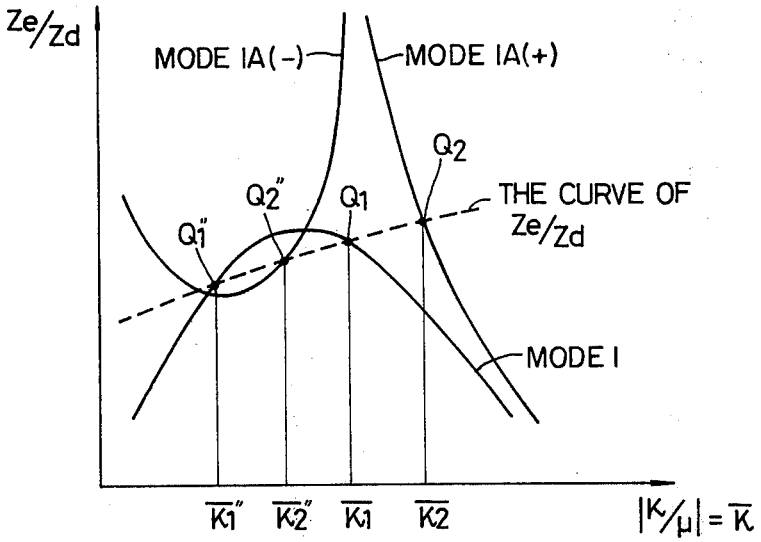

For an example of one of the most simplified models, assume that an intermediate operation is found on the magnetic field intensity locus $H_0$ shown in FIG. 10, and the intermediate operation is chosen between the double circulation frequency operation and the double circulation direction operation. Resonant mode curves, circulation mode curves and constant internal magnetic field loci are respectively shown by solid, dashed and dot-dashed lines. When the magnetic field is $H_a$, operating points $P_1$ and $P_2$ are found. When the magnetic field is stepped up to $H_b$, then they become $P_1''$ and $P_2''$. Suppose that one can make all these points satisfy the second circulation condition, and $Q_1$, $Q_2$, $Q_1''$ and $Q_2''$ are found on the curve of $Z_e/Z_d$ as shown in FIG. 11. These circulation adjustments being achieved, the circulator can perform the double circulation frequency operation under the magnetic field intensity $H_a$, and it can perform the double circulation direction operation under the magnetic field intensity $H_b$. This is the principle of a switching operation by which the circulator can be switched from the double frequency operation to the double direction operation and vice versa, by stepping up the magnetic field intensity from $H_a$ to $H_b$ and by stepping it down from $H_b$ to $H_a$.

One can conclude that the circulator loaded with the ferrite-dielectric-conductor composite of an adequate ratio $r_0/r_1$ and an adequate length of the conductor can perform the switching operation between the double frequency operation and the double direction operation. This is really the case in which the relations $f_2 = f_1'$ and $f_3 = f_2'$ hold as shown in FIG. 6, regarding the ferrite-conductor-composite circulator.

There is possibility of a further multiple mode operation in which mode 1 (mode 1B(+) and mode 1B(−) included), mode 1A with (+) or (−), mode 2(−) and mode 3(+) can play their respective roles. One can realize various multiple circulation frequency operations together with multiple direction operation in a multiple-port-junction circulator loaded with the ferrite-dielectric-conductor composite, by modifying the ferrite and by adjusting such factors as the ratio $r_0/r_1$, length of the conductor, specific permittivity and ratio $r_1/r_2$ of the dielectric ring.

Another variety of composite can be made by replacing the single ferrite ring with a multi-layer heterogeneous ferrite ring consisting of a plurality of concentrically disposed ferrite ring layers of different saturation magnetizations. An example of such type of composite is shown in FIG. 12. It is made of three ferrite rings (7), (8), (9) with different saturation magnetizations, one dielectric ring (10) and one conductor (11).

At this time, I shall describe resonant modes and circulation modes of a composite made of two ferrite portions, that is, a double layer heterogeneous ferrite composite, before entering into an analysis of the above-mentioned multi-layer heterogeneous ferrite composite.

Figure 13:
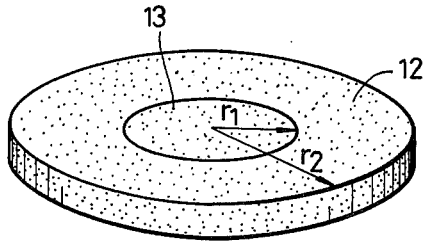
FIG. 13 is a perspective view showing an example of a ferrite-ferrite composite.

The single junction heterogeneous ferrite composite is a composite consisting simply of one ferrite ring and a ferrite puck enclosed therein, these components being assembled in one disk shape. The configuration of the composite is shown in FIG. 13. The geometry of the ferrite ring is such that it has an inner radius $r_1$, outer radius $r_2$ and ratio $r_1/r_2$. The ferrite puck has the radius $r_1$.

Figure 14:
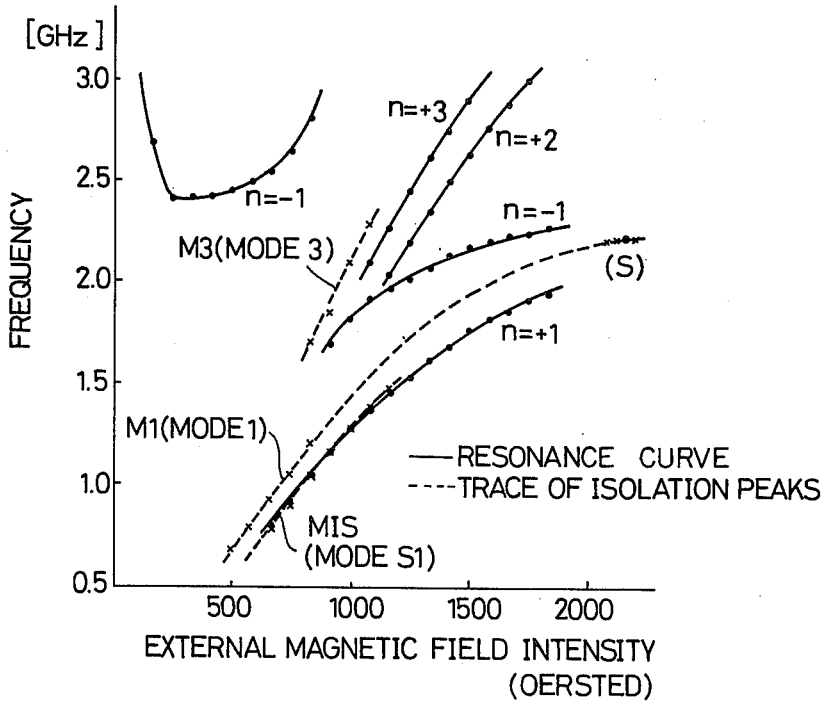
FIG. 14 is a graphical diagram showing experimental results of the operation of a circulator incorporating the ferrite-ferrite composite shown in FIG. 13.

Resonant mode curves and curves of maximum isolation (isolation peaks) are measured for this composite and plotted in the mode chart. An example of the measured mode chart is shown in FIG. 14. The composite used has saturation magnetizations $4\pi M_s$ of 750 and 1200 Gauss for the ferrite ring and ferrite puck, respectively, specific permittivity $\epsilon$ of 14 for both, $r_2 = 10$ mm and $r_1/r_2 = 0.45$.

It is summarized, for the same $r_1/r_2$ value and $r_2$, that (1) when the saturation magnetization of the ring ferrite is less than that of the ferrite puck, resonant modes of the double-layer-ferrite-composite resonator exist in a lower frequency region than those of the single ferrite disk resonator of the same saturation magnetization as that of the ferrite ring of the composite; (2) the resonant modes of the ferrite-dielectric-composite resonator shift largely towards the higher frequency than those of the disk ferrite resonator, but resonant modes of the double-layer-ferrite-composite resonator shift only a little bit and almost stay in the vicinity of those of the disk ferrite. Therefore, I conclude that measured resonant modes in the mode chart of the double-layer-ferrite-composite resonator, as plotted in FIG. 14, are the normal modes because they exist in the vicinity of the resonant modes of the disk ferrite resonator and they resemble these resonant normal modes.

In FIG. 14, measured values of isolation peaks are superimposed upon the resonance curves in the mode chart for the case of the double layer ferrite composite. The composite used has saturation magnetizations $4\pi M_s = 750$ Gauss for the ring ferrite and 1200 Gauss for the ferrite puck, a half width of these ferrites of 80 Oe., a specific permittivity 14 for both, an outer radius of the ring of 10 mm, a ratio $r_1/r_2 = 0.45$, and a thickness 2.5 mm. Measured curves of isolation peaks are shown by dashed lines, $M_1$, $M_{1s}$ and $M_3$. Curve $M_1$ is believed to correspond to the circulation curve of mode 1 mainly by virtue of the resonant modes $n=+1$ and $-1$, and also curve $M_3$, to the circulation curve of mode 3 mainly by virtue of the resonant modes $n=+3$ and $n=-1$.

It is surely apparent that curve $M_1$ resembles the maximum isolation curve of mode 1 of the disk ferrite resonator and the resonance curves $n=+1$ and $-1$ resemble those of the disk ferrite resonator. However, curve $M_{1s}$ exists at a frequency lower than that of curve $M_1$ and almost on the resonance curve $n=+1$. It is really a new phenomenon, judging from the experimental results, that curve $M_{1s}$ has no counterpart in the single disk ferrite circulator and in the ferrite-dielectric -composite circulator. It is then necessary to introduce the concept of a subsidiary mode to make it clear. The normal and subsidiary modes are characterized in the $k_{e2}r_2$ versus $\kappa/\mu$ relationship to meet the experimental results that (1) the normal modes are almost all the same as those of the disk ferrite and its circulator; (2) the subsidiary modes exist in the region lower than the normal modes; (3) the normal modes and the subsidiary modes coexist, and they independently play their respective roles in circulation, without any disturbance; (4) each circulation mode curve of the subsidiary modes exists in the region lower than that of the normal modes, under given specifications.

Figure 15:
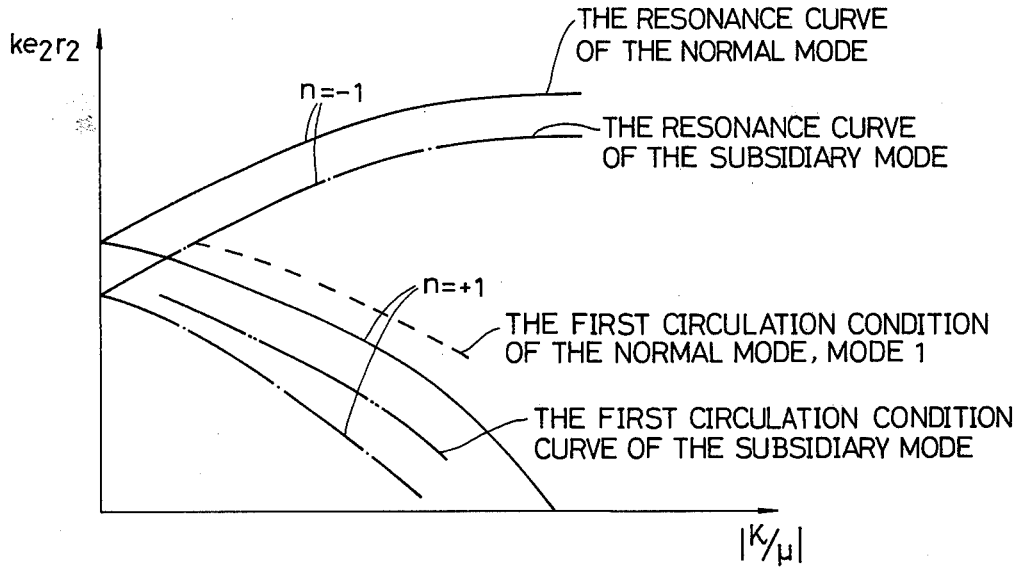
FIG. 15 is a graphical diagram showing relationships between a normal mode and a subsidiary mode.

FIG. 15 shows interrelationships between resonant normal mode curves (solid lines) and subsidiary mode curves (dot-dashed) of the lowest order, and between a normal circulation mode curve (dashed) and a subsidiary circulation mode curve (double dot-dashed).

In FIG. 16(a), distribution profiles of saturation magnetization $4\pi M_s$, ferrite anisotropic splitting factor $\kappa/\mu$ and specific effective permeability $\mu_e$ of the composite are shown. In this case, the saturation magnetization of the ferrite puck is larger than that of the ferrite ring.

In analyzing the electromagnetic field problems in the double-layer-ferrite composite, in order to satisfy the above-mentioned conditions which are required from the experimental results, one must take into account the $\kappa/\mu$ distributions which assume significant roles. It is summarized that (1) the $\kappa/\mu$ distribution effective for the normal mode is assumed to be uniform over the whole of the composite, so that the ferrite disk has a uniform distribution of $\kappa/\mu$ and there the normal mode exists; (2) $\kappa/\mu$ distribution effective for the subsidiary mode takes the same value $\overline{K}_2(=\kappa/\mu)$ of the ferrite ring in the region of the ferrite ring and the value of $(\overline{K}_1-\overline{K}_2)$ in the region of the ferrite puck; whereby, (3) the electromagnetic fields inside the ferrite puck are substantially divided into two parts, one of which is for the normal mode and the other for the subsidiary mode. The profile of the $\kappa/\mu$ distribution is shown in FIG. 16(b).

According to the considerations stated above, one can obtain the electromagntic fields effective for the normal mode and subsidiary mode, respectively. Regarding the $+\nu-$th normal mode, only $E_z$ and $H_{74}$ among the em field components are $$E_{z\nu}=a_{84}J\nu(k_{el}r)e^{-j\nu\theta}, \tag{10}$$

$$H_{\theta\nu}=-j\eta_1 a_\nu[J_\nu'(k_{el}r)-\overline{K}_{2\nu}/k_{el}r\,J_\nu(k_{el}r)]e^{-j\nu\theta}, \tag{11}$$

Regarding the $+\nu-$th subsidiary mode, only $E_z$ and $H_{74}$ among the em field components are $$E_{z\nu}=a_{84}J_\nu(k_{el}r)e^{-j\nu\theta}, \tag{12}$$

$$H_{\theta\nu}=-j\eta_1 a_\nu[-K_1-K_2/k_{el}r\,\nu J_\nu(k_{el}r)]e^{-j\nu\theta}, \tag{13}$$

where $$\eta_1=\sqrt{\epsilon_0\epsilon_{el}/\mu_0\mu_{el}}$$

$$k_{el}^2=\omega^2\epsilon_0\mu_0\epsilon_{el}\mu_{el},$$

$$\mu_{el}=\mu_1[1-\overline{K}_1^2],$$

$$\overline{K}_1=\kappa_1/\mu_1,$$

$$\overline{K}_2=\kappa_2/\mu_2,$$

$\epsilon_{el}$ is the specific permittivity of the ferrite puck and $\mu_{el}$ the specific effective permeability. Similarly, the radial component of the magnetic field is derived. The em fields inside the ferrite ring are easily derived from Maxwell's equations.

Now, one can obtain the characteristic equations giving the resonant mode curves, by applying the continuity relations to tangential em field components at the boundary $r=r_1$ and the condition of the magnetically short-circuited edge $H_\theta=0$ at the periphery of the composite $r=r_2$. The theoretical results agree with the resonance curves in FIG. 15.

The physical roles of the normal mode and subsidiary mode in the composite are restated as follows. There is a discontinuity of $\kappa/\mu$ between the ferrite ring and the ferrite puck under the equal magnetic field intensity, because the saturation magnetization of the ferrite ring is different from that of the ferrite puck. As the em fields are excited outside the ferrtie ring, and they come through the ring, the rotating em fields inside the ferrite puck are forced to divide into a portion matched to the rotating em fields of the ferrite ring Eqs. (10) and (11) and into an unmatched remainder portion Eqs. (12) and (13), which portions contribute to the normal mode and subsidiary mode, respectively. Applying the continuity conditions of tangential components of em fields at $r=r_1$, one can derive the em fields of the normal mode from Eqs. (10) and (11) and the em fields of the ferrite ring referring to Eq. (1) (other magnetic field components are not written yet), and the em fields of the subsidiary mode from Eqs. (12) and (13) and the em fields of the ferrite ring. The magnetic field component $H_{\theta\nu}$ of Eq. (11) for the normal mode is allowed to add to the magnetic field component of Eq. (13) for the subsidiary mode under a given internal magnetic field intensity and frequency, because they are divided from the original solution to the Maxwell's equations, so that only the joint form of Eqs. (11) and (13) can satisfy the Maxwell's equations and becomes orthonormal. Any one mode, either the normal mode or the subsidiary mode, can not form the orthonormal mode system.

The two ferrite composite has a junction plane at $r=r_1$, between the ferrite puck and ring, and the $\kappa/\mu$ value discretes across this plane. It is thought that such discrepancy of the $\kappa/\mu$ value brings forth the subsidiary mode with the normal mode, and they do not interfere with each other. For instance, if one can set up the circulator with the composites which hold such discrepancy of $\kappa/\mu$ in the radial coordinate, the normal mode and the subsidiary mode additionally play their roles in circulation, and in consequence, another type of double circulation frequency operation appears.

The separation between the circulation frequencies of the normal and subsidiary modes, as a matter of fact, is caused by the discontinuity of $\kappa/\mu$ which depends on a difference of saturation magnetization between the two ferrites. In fact, it is small in comparison with the separation between the double circulation frequencies of the ferrite-dielectric-composite circulator. However, if one can apply this narrow band operation, one can perform broadbanding of a circulator without any external broadbanding circuits.

The operation of the circulator loaded with the multilayer heterogeneous ferrite-dielectric-conductor composite can be clarified on the basic theory that the subsidiary mode plays a distinct role in the circulator loaded with the double layer ferrite composite.

At the outset, assume a case where the ratio of the radius $r_0$ of the conductor (11) to the outer radius $r_1$ of the dielectric ring is small, and the dielectric part is dominant over the conductor portion. Then, the main part of circulation is characterized by normal mode operation by virtue of circulation mode 1, mode 1A(+), mode 3 and others in the composite of the triple layer heterogeneous ring ferrites (7), (8), (9) and dielectric (10). The rest of the circulation is caused to be a subsidiary mode operation originating from the $\kappa/\mu$discontinuities inside the heterogeneous ferrites (7), (8) and (9).

The circulator action of the triple-layer-heterogeneousferrite-dielectric-conductor-composite resonator is a complex operation involving both the normal mode operation of the elementary ferrite-dielectric-conductor-composite resonator and the subsidiary mode operation of the triple layer heterogeneous ferrite. It is, after all, a broadbanded multiple circulation frequency operation.

For instance, one should think of the mode 1 operation and assume that two subsidiary modes are involved in the circulation. Then, one can observe that three peaks of isolation appear at three frequencies, $f_{M1}$for the naormal mode 1, $f_{S1}$ and $f_{S2}$ for two subsidiary modes. In consequence, the circulator characteristics are totally broadbanded, as shown in FIG. 17.

If the conductor is enlarged, and contrarily the dielectric portion is reduced, then in the circulator-action, the double circulation direction operation appears with other complex operations such as multiple circulation frequency-circulation direction operation. In this case, subsidiary modes contribute to broadbanding each circulation operation.

When the ratio of conductor radius $r_0$ and dielectric ring outer radius $r_1$ takes a certain given value, one can switch the multiple circulation frequency operation off to the double circulation direction operation and back, alternately. In this case, subsidiary modes contribute to broadbanding each circulation operation.

If one can properly adjust the ratio of $r_0/r_1$, the conductor radius $r_0$ and its length, and outer radius $r_1$ of the dielectric ring, the circulator adjustments are performed and the input impedance of the circulator is matched to the wave impedance of connected transmission lines.

Briefly stated, one can realize that the circulator loaded with the ferrite-dielectric-conductor composite can be made as a matter of choice to perform in a multiple circulation frequency operation, a double direction operation among complex operations, a switching operation and as an internal impedance adjustment mechanism, and that he can also utilize the broad-banding effect which is brough forth in the multi-layer heterogenous ferrite.

Effects of a nonuniform magnetic field will now be described. All things mentioned above belong to the case where the circulator operation is under a uniform magnetic field. The next important problem concerns circulator-actions under nonuniform magnetic fields. Before proceeding with an explanation of such actions, it may be useful to deepen one's understanding of the physics of the ferrite material under a given uniform magnetic field, in order to extend the theoretical treatments to ferrite material under nonuniform magnetic fields.

The ferrite material under a given magnetic field is described by specific permeability tensor $[\mu]$ $$[\mu] = \begin{bmatrix} \mu, & -j\kappa, & 0 \\ j\kappa, & \mu, & 0 \\ 0, & 0, & \mu_3 \end{bmatrix},$$

Elements of the permeability tensor $\mu$, $\kappa$ are important factors depending on frequency and internal magnetic field. Usually, there have dissipation factors, which are neglected for convenience to describe the physical properties of the ferrite material. $\mu$ and $\kappa$ are given by Polder's equations above ferromagnetic resonance as follows:

$$\mu = 1 \times hm/h^2 - 1, \tag{15}$$

$$\kappa = m/h^2 - 1, \tag{16}$$

where $m = 4\pi M_s/H_0$, $h = H_i/H_0$, $4\pi M_2$ = saturation magnetization of the ferrite (Gauss);

$H_i$ = internal magnetic field intensity (Oersted), which is given by $H_i = H_{ex} - N \cdot 4\pi M_s$, where $H_{ex}$ is the external biasing magnetic field and N the demagnetizing factor depending on the ferrite geometry;

$H_0$ = resonance field intensity given by $f$(MHz)/2.8 (oersted).

Theoretical treatments are made above ferromagnetic resonance.

In analyzing a circulator loaded with the ferrite as the core resonator, there are two major factors that have importance. They are specific effective permeability $\mu_e$ and ferrite anisotropic splitting factor $\kappa/\mu$, which are derived from $\mu$ and $\kappa$.

As is well known, specific effective permeability $\mu_e$is dependent on the anisotropic splitting factor $\kappa/\mu$and is given by $$\mu_e = [\mu^2 - \kappa^2]/\mu = \mu[1 - (\kappa/\mu)^2]. \tag{17}$$

Using Eqs. (15 and (16) and taking $m$ ($=4\pi M_s/H_0$) for a parameter, one can plot the $\mu_e$ versus $h$ ($=H_i/H_0$) relationship and the $\kappa/\mu$ versus $h$ relationship. They are shown in FIG. 18 and FIG. 19.

Properties of the ferrite material are completely characterized by these relationships with given internal magnetic field intensity $H_i$and frequency $f$. Of course, it is possible to calculate $\mu_e$ and $\kappa/\mu$ at a given internal state prescribed by $H_i$ and $f$ (or $H_0$).

For instance, assume that a circulator is set above ferromagnetic resonance, that is, it is kept in the state for $h < 1.0$, with a given saturation magnetization. One can understand from these figures that (1) at a given frequency, if the internal magnetic field $H_i$ increases, points $P_1$ and $Q_1$ on constant $m$ curves, for instance, having the initial value $h_1$ ($=H_1/H_0$), move along these constant $m$ curves in the direction of $h$ increasing;

(2) at a given internal magnetic field $H_i$, if the frequency $f$ increases, points $P_2$ and $Q_2$, for instance, having the initial value $h_1$, move along the dashed lines in the direction of $h$ increasing (shown by an arrow), and vice versa if the frequency decreases.

With the knowledge of the above-mentioned basic properties of the ferrite material under the uniform magnetic field, one can explain complex properties of the ferrite under a nonumiform magnetic field and the action of a circulator loaded with the heterogeneous ferrite.

As shown in FIG. 20, suppose that the composite is made by combining a ferrite puck $F_1$ of radius $r_1$, ferrite rings $F_2$, $F_3$, $F_4$ inner and outer radii, $r_1$, $r_2$; $r_2$, $r_3$; $r_3$, $r_4$, respectively. The ferrites $F_1$, $F_2$, $F_3$ and $F_4$ respectively have saturation magnetizations $4\pi M_{s1}$, $4\pi M_{s2}$, $4\pi M_{s3}$ and $4\pi M_{s4}$ in the decreasing order given by $4\pi M_{s1} > 4\pi M_{s2} > 4\pi M_{s3} > 4\pi M_{s4}$, for instance.

If the composite is placed under a uniform DC magnetic field and if the internal magnetic field is equal in each ferrite ring, then the value of $m_i(=4\pi M_{si}/H_0, i = 1, 2, 3, 4)$ for the $i$-th ferrite becomes in decrasing order $m_1 > m_2 > m_3 > m_4$ and therefore the 78 /82 value of the $i$-th ferrite is determined by $(\kappa/\mu)_1 > (\kappa/\mu)_2 > (\kappa/\mu)_3 > (\kappa/\mu)_4$. Each ferrite element in the composite has a different value of $\kappa/\mu$, so that subsidiary modes arise and contribute to broadbanding the circulator loaded with the composites as mentioned earlier. Now, if one tries to plot resonance point corresponding to each ferrite ring in the $\kappa/\mu$ versus $h$ graph, he obtains points $P_1'$, $P_2'$, $P_3'$ and $P_4'$ on the same value of $h_i$ as is shown in FIG. 21.

Suppose that when a nonuniform magnetic field is applied, internal magnetic fields in the ferrites $F_1F_2$, $F_3$ and $F_4$ respectively become $H_{i1}$, $H_{i2}$, $H_{i3}$ and $H_{i4}$, which are different from the uniform field $H_i$. At a given frequency, if the magnetic field is changed from the uniform field to a nonuniform field, then the resonance point in each ferrite element moves from a point under the uniform field to a new point under the nonuniform field along a corresponding m curve. Therefore, the points $P_1'$, $P_2'$, $P_3'$ and $P_4'$ are now found somewhere in the m curves. If it is adequately adjusted, the nonuniform field can make these points have an equal value of $\kappa/\mu$ as shown for points $P_1$, $P_2$, $P_3$ and $P_4$ in FIG. 21. It means that every ferrite in the composite has a common $\kappa/\mu$ value only. On the other hand, $\mu_e$ values in the composite are found at points $Q_1$ to $Q_4$ in the $\mu_e$ versus h graph, giving $\mu_{e1}$ to $\mu_{e4}$ as shown in FIG. 22. All the points $Q_1$, $Q_2$, $Q_3$ and $Q_4$ are practically on the line AB. Corresponding $\mu_e$ values are in a decreasing oder, $\mu_{e1} > \mu_{e2} > \mu_{e3} > \mu_{e4}$.

Suppose that only the frequency changes under a given nonuniform magnetic field. Then, all resonance points in the composite, that is, represented by $P_1$ to $P_4$, $Q_1$ to $Q_4$, move in the same way as an arrow shows in FIGS. 18 and 19.

Now, I shall describe the circulator action taking place in the circulator loaded with the multi-layer heterogeneous ferrite composite under the nonuniform magnetic field prescribed to hold the common $\kappa/\mu$ value in the whole composite. In analyzing the circulator action, the $\mu_e$ distribution inside the composite has importance. Using $\mu_e$ values of all ferrites derived from the points $Q_1$ to $Q_4$, one can obtain the $\mu_e$ distribution in the $\mu_e$ versus r (radial coordinate) graph as shown in FIG. 23. Strictly speaking, this composite has four layers of ferrites denoted by $F_1$ to $F_4$, so that it provides a four-step profile, which is approximated by a line CD.

One can obtain resonant modes, using this approximate profile of $\mu_e$ inside the composite. This approximated line can be far improved in the course of developing the manifold heterogeneity in the composite.

Computed examples of the resonant mode curves are shown in FIG. 24, respect to $n=+1$ and $-1$ in the composite in which the nonuniform magnetic field is applied to produce the common $\kappa/\mu$ distribution. There is also the first circulation condition curve (dashed) depending on the coupling angle $2\Psi$ of the stripline shown, in addition to the constant magnetic field curve. To adjust the mode 1 curve of the first circulation condition and a constant magnetic field locus to overlap over the range between P and Q, it can be achieved by changing several factors, such as the coupling angle $2\Psi$, the biasing magnetic field and its profile and so on. The second circulation condition can be satisfied similarly over the same range between P' and Q'. It approximately gives the circulator band $(f_2 - f_1)$ where the circulation adjustments are completely performed over the range from P to Q (The frequency band is actually a little larger than $(f_2 - f_1)$.).

Consideration is now given to a circulator loaded with a multi-layer heterogeneous ferrite-dielectric-conductor composite, to which the nonuniform DC magnetic field is applied to hold a common $\kappa/\mu$ value. If the effect of the conductor is more dominant than that of the dielectric, it produces by choice a double direction operation, and contrarily it produces a multiple circulation frequency operation when the dielectric is predominant. However, the ratio of the conductor and the dielectric is adequately chosen, so that the circulator can be switched from the double direction operation to the double circulation frequency operation and vice versa.

There are several varieties of operation between multiple frequency operation and multiple direction operation besides the mechanism of internal impedance adjustment in the circulator actions of the circulator loaded with such heterogeneous ferrite-dielectric-conductor composites. They generally have the feature that a common $\kappa/\mu$ value must be kept over the whole composite.

Roughly speaking, the frequency band, with respect to the lowest normal mode operation, is mainly dependent on the ratio of inner to outer radii of the heterogeneous ferrite, even if it is interanlly broadbanded (i.e., no use of external matching circuits), because any increase of that ratio makes the heterogeneous ferrite slender and recessive, and then the frequency band becomes narrower.

A multi-layer-heterogeneous-ferrite-dielectric-conductor-composite resonator has the unique resonant mode, whose degenerate point comes frequently below that of the disk ferrite resonator, though it depends on the effect of conductor and dielectric. However, a circulator with this resonator can have smaller geometry in comparison with a disk ferrite circulator. It is possible to make a larger separation between the lowest pair of rotating modes and the next pair. One can utilize the properties of the resonant mode in producing a new circulator action.

It is really a composite resonator where a certain nonuniform DC magnetic field brings forth a stepwise distribution of $\kappa/\mu$ in the whole heterogeneous ferrite. Almost generally, a nonuniform magnetic field, except the particular nonuiform magnetic field above mentioned, can bring about the desired value of $\kappa/\mu$ merely in a short section, i.e., two or three layers, but not in the whole. As a results, the stepwise distribution of $\kappa/\mu$ induces several discontinuities of $\kappa/\mu$ inside the heterogeneous ferrite, which causes a subsidiary mode-like operation to contribute to the circulator action, in addition to a normal mode-like operation. One can imagine, for instance, in FIG. 20 that the ferrites $F_1$ and $F_4$ have the value $(\kappa/\mu)_1$ and the ferrites $F_3$ and $F_4$ have the value $(\kappa/\mu)_2$. A complex circulator-action can now be divided into two contributions. One is the normal mode-like operation in which the resonant mode with a common $\kappa/\mu$ value in the whole ferrite plays one role, and the other is the subsidiary mode-like operation in which the resonant mode caused by different $\kappa/\mu$ values in two groups of ferrites plays the other role. One can again realize a broadbanding of the circulator to which the nonuniform DC magnetic field is applied to bring about partially uniform distribution of $\kappa\mu$ in the heterogeneous ferrite.

One can realize a desirable circulator action in the circulator loaded with a multi-layer heterogeneous ferrite-dielectric-conductor composite to which a nonuniform magnetic field is applied to bring forth the uniform distribution of $\kappa/\mu$. Application of the nonuniform magnetic field to the multilayer heterogeneous ferrite part is effective to broaden the frequency band and to ensure desirable circulator performance.

Multiple frequency operation, double or triple direction operation (in the Y- or X-junction), and broadbanded operation are realized in the circulator loaded with such heterogeneous ferrite-dielectric-conductor composites to which the nonuniform magnetic field is applied, and also an internally adjustable matching mechanism is applicable.

What is the internally adjustable matching mechanism?This mechanism has two meanings. One is applicable during circulation adjustments. The other is applicable when the circulation adjustments are finished. During such circulation adjustments, the second circulation condition curve is required to meet the curve of junction intrinsic wave impedance ratio $Z_e/Z_d$ or to overlap it over as long a range as possible. It is possible to overlap these curves with each other, by making this mechanism work well. The first case has already been demonstrated in FIG. 25.

The second case is to utilize the effects of both normal and subsidiary modes. As for the normal mode, adjustment between the second circulation condition curves and the curve of $Z_e/Z_d$ is just the same as it was with FIG. 25. In FIG. 29, curves of the second circulation condition for both normal and subsidiary mode of the lowest order are drawn together with the curve of $Z_e/Z_d$. The curve of the normal mode overlaps the $Z_e/Z_d$ curve from $Q_1$ to $Q_1$ and then the curve of the subsidiary mode overlaps it from $Q_{1s}$ to $Q_{1s'}$. Therefore, the total overlaps range from $Q_{1s}$ to $Q_1$ and simply indicate a broadbanding.

After the circulation adjustments, the input impedance of the circulator must match the wave impedance of externally connected transmission lines. It is the circulator adjustments that are practically important, In practical use, impedance matching is achieved by utilizing broadbanding transformers, or by using transmission line tapers. Now, turning back to the second circulation adjustment stage, if one sets, for $Z_d$, the wave impedance $Z_{ex}$ of externally connected transmission lines, then the circulation adjustments result in including input impedance matching at large and the circulator adjustments are completed. The input impedance becomes equal to the wave impedance of externally connected transmission lines.

FIG. 26 shows still another modification of the composite according to the invention. The modified composite comprises heterogeneous ferrite pieces combined together with dielectric rings 14, 15 and 16 placed between adjacent ferrite pieces. It is frequently necessary to replace ferrite pieces in the multi-layer heterogeneous ferrite composite. Each of the dielectric rings acts as an buffer to keep each separated heterogeneous ferrite piece free from the others, and it works to decrease internal stresses which arise during manufacture from sintering.

If one can apply a magnetic field to a selected piece or pieces of mutually separated one of these heterogeneous ferrite pieces and move the magnetic field to apply it to the next piece or pieces, the substantially active portion of these separated heterogeneous ferrite pieces can be changed piece by piece. Then, one can freely adjust the internal impedance matching, and accordingly vary circulation frequencies because the effective radius of the substantially active portion can be changed. Using this mechanism, one can realize an operation to make the whole circulation frequency band shift upwards or downwards. The above-mentioned technique can also be applied to get a modified ferrite-dielectric-conductor composite, by replacing each ferrite pieces with a separated heterogeneous ferrite piece.

To demonstrate the usefulness of the circulator actions, such as the multiple frequency operation involving double direction operation, examples of microwave circuits wll now be presented.

Figure 27A:
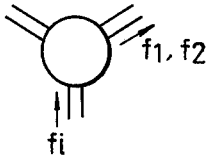

A double frequency operation associates the broadbanded circulator characteristics with the effect of a band rejection filter. For instance, consider a circulator which operates at the frequencies $f_1$ and $f_2$. If signal waves $f_i$ are incident upon the input port, only two waves $f_1$ and $f_2$ comes out of the output port after filtering and circulation as shown in FIG. 27(a). This symbolically denoted in FIG. 27(b).

Figure 27B:
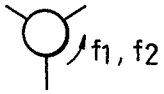
Figure 27C:
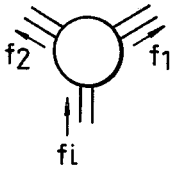

The double direction operation works at the frequency $f_1$ with counterclockwise rotation and at the frequency $f_2$ with clockwise rotation as shown in FIG. 27(c). Therefore, if signal waves $f_1$ and $f_2$ are incident upon the input port, the wave $f_1$ comes out of the second port after the counterclockwise rotation and the wave $f_2$ comes out of the third port after the clockwise rotation. This is symbolically denoted in FIG. 27(d).

A combination of the double or multiple frequency operation and the double direction operation makes frequency band separation (division) and frequency band synthesis realizable in the circulator circuitry.

Figure 27D:
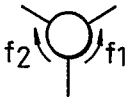

Several examples are depicted in FIG. 28, using the symbols given in FIGS. 27(b) and 27(d). FIG. 28(a) shows an example of frequency band separation in which the incident wave including frequencies $f_1$, $f_2 f_3$ and $f_4$ is divided into four waves of respective frequencies, $f_1$, $f_2$, $f_3$ and $f_4$. Three circulators are connected in series. The signal wave including $f_1$, $f_2$, $f_3$ and $f_4$ is incident upon the port $P_{1c1}$. The first circulator $C_1$ rotates the waves of $f_1$, $f_2$ and $f_3$ counterclockwise and the wave of $f_4$ clockwise, as it performs double direction-quadruple frequency operation. The wave of $f_4$ comes out of port $P_{3c1}$. The other wave of $f_1$, $f_2$ and $f_3$ comes out of port $P_{2c1}$ and is subsequently incident upon the input port $P_{2c1}$ of circulator $C_2$. Therefore, the wave $f_4$ is divided from the wave of $f_1$, $f_2$ and $f_3$. Circulator $C_2$ performs the double direction-triple frequency operation. The circulator $C_2$ rotates the wave of $f_1$ and $f_2$ counterclockwise and the wave of $f_3$ clockwise, and separates the wave of $f_3$ from the wave of $f_1$ and $f_2$. The wave of $f_1$ and $f_2$ comes out of the second port $P_{3c1}$ and the wave of $f_3$ comes out of the Port $P_{3c2}$. Circulator $C_3$ performs the double direction-double frequency operation. The wave $f_2$ is likewise separated from the wave $f_1$. In the above-described manner, all the waves $f_1$, $f_2$, $f_3$ and $f_4$ are separated into four waves.

Figure 28A:
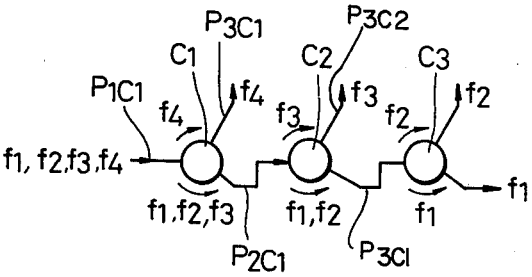
Figure 28B:
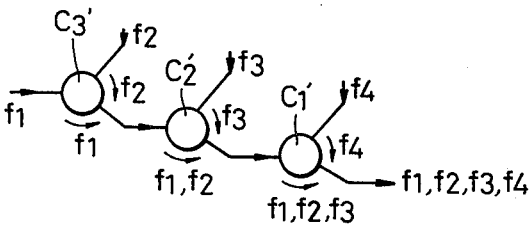

FIG. 28(b) shows an example of frequency band synthesis by which four waves $f_1$, $f_2$, $f_3$ and $f_4$ are combined together into a wave including $f_1$, $f_2$, $f_3$ and $f_4$. Three circulators $C_1'$, $C_2'$ and $C_3'$ are connected in series. These circulators $C_1'$, $C_2'$ and $C_3'$ are respectively identical with the circulators $C_1$, $C_2$, and $C_3$ of FIG. 28(a). Circulator $C_3'$ combines wave $f_1$ and wave $f_2$ together, circulator $C_2'$ combines waves $f_1$, $f_2$ and wave $f_3$ together and finally circulator $C_1'$ combines waves $f_1$, $f_2$, $f_3$ and $f_4$ together at the output port of $C_1$.

Figure 28C:
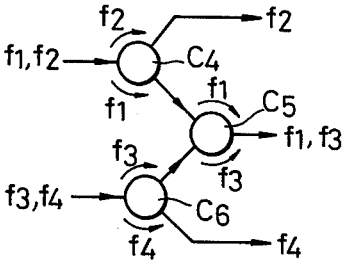
Figure 28D:
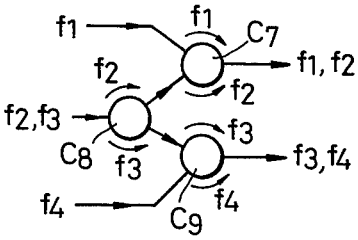

FIG. 28(c) shows an example of a two input-three output mode of operation. FIG. 28(d) shows an example of a three input-two output mode of operation.

The circulator circuit shown in FIG. 28(c) can transform two input signals of ($f_1$, $f_2$) and ($f_3$, $f_4$) into three outputs $f_2$, ($f_1$, $f_3$) and $f_4$. The circulator circuit shown in FIG. 28(d) can transform three input signals of $f_1$, ($f_2$, $f_3$) and $f_4$ into two outputs ($f_1$, $f_2$) and ($f_3$, $f_4$).

By constructing a circulator from the resonator according to the present invention, one can realize the simplification of various circuits and eventually facilitate the development of new circuitry techniques.

Description has been made about the composite resonators according to the present invention and their applications to a stripline Y-junction circulator, on the assumption that the geometry of the composite resonators is simply a disk shape, so as to adapt to the stripline Y-junction. It should, however, be understood that there is no restriction on the geometry of such composite resonators, because the composite according to the invention such as the multiple heterogenous ferrite-dielectric-conductor composite and its construction can be transposed from the radial coordinate to the $z$ direction (the direction of thickness) and from the circular type to a noncircular type. A junction plane between every two different ferrite materials provides a discontinuity of the anisotropic splitting factor $\kappa/\mu$ which causes the subsidiary mode to be generated, besides the normal mode, both modes playing their respective roles in circulation. When the nonuniform magnetic field is applied, no matter whether it is under a uniform distribution of $\kappa/\mu$ or a partially uniform distribution, the broadbanding effect is achievable. If a conductor and dielectric are employed in the composite, the ratio of the conductor radius to the dielectric radius or to the composite radius, the length of the conductor, etc. determine the circulator action, circulation adjustments, circulator adjustments of multiple frequency operation and double direction operation and control of circulation direction.

It is important to say that the composite resonators of the present invention are applicable to not only a stripline Y-junction but also to a waveguide junction, an X-junction, a microstrip junction, an isolator, a filter, a phaseshifter, and so on. By virtue of the fact that one can apply the composite resonator of the present invention to an isolator, it is even possible to realize different isolators from the multiple frequency operation, broadbanding operation, switching operation, and internal impedance matching mechanism.

Moreover, since the composite resonator is usable as a filter, different filter varieties are realizable including bandpass filters and band rejection filters. As a matter of fact, the composite resonator, when applied to some microwave devices to improve their original characteristics, can develop a latently held utility of the devices.

As will be apparent from the above description, the composite resonator of the present invention, when it is appropriately applied to microwave devices, can impart to them broadband operation, multiple frequency operation, multiple direction operation, varieties of these antecedents, and an internal impedance matching mechanism obviating any sophisticated matching transformer.

What is claimed is:

1. A composite resonator comprising a composite made of a centrally disposed conductor puck, a solid dielectric layer disposed concentrically with and adjacent to said conductor puck and a ferrite layer disposed concentrically with and adjacent externally to said dielectric layer, and an external magnetic field source for applying an external magnetic field of predetermined intensity to said composite so that at least two circulation modes perpendicular to said magnetic field can coexist, said ferrite layer being a multi-layer composite made of a plurality of directly contacting concentric layers having mutually different saturation magnetizations for utilizing at least one subsidiary circulation mode produced in said multi-layer composite.

2. A composite resonator as defined in claim 1, wherein said external magnetic field source applies a nonuniform external magnetic field to said multi-layer composite, said composite having a predetermined distribution of the anisotropic splitting factor $k/\mu$.

3. A composite resonator comprising a composite made of a centrally disposed conductor puck and a ferrite layer disposed concentrically with and adjacent to said conductor puck, and an external magnetic field source for applying an external magnetic field of predetermined intensity to said composite so that at least two circulation modes perpendicular to said magnetic field can coexist, said ferrite layer being a multi-layer composite made of a plurality of directly contacting concentric layers having mutually different saturation magnetizations for utilizing at least one subsidiary circulation mode produced in said multi-layer composite.

4. A composite resonator as defined in claim 3, wherein said external magnetic field source applies a nonuniform external magnetic field to said composite and wherein said composite has a predetermined distribution of the anisotropic splitting factor $k/\mu$.

5. A composite resonator comprising a ferrite composite made of at least three concentrically disposed ferrite layers, thin dielectric layers interposed between the respective layers of said ferrite composite to weaken electromagnetic coupling of adjacent ones of said ferrite layers, and an external magnetic field source for applying an external magnetic field of predetermined intensity to said composite.

6. A composite resonator as defined in claim 5, wherein the external magnetic field source selectively applies the magnetic field to said ferrite layers for switching the operating region thereof.

7. A composite resonator comprising a composite made of a centrally disposed dielectric puck and a ferrite layer disposed concentrically with and adjacent to said conductor puck, and an external magnetic field source for applying an external magnetic field of predetermined intensity to said composite so that at least two circulation modes perpendicular to said magnetic field can coexist.

8. A composite resonator as defined in claim 7, wherein said ferrite material is a multi-layer composite made of a plurality of ferrites having mutually different saturation magnetizations for utilizing at least one subsidiary circulation mode produced in said multi-layer composite.

* * * * *

UNITED STATES PATENT AND TRADEMARK OFFICE

CERTIFICATE OF CORRECTION

PATENT NO. : 4,122,418

DATED : October 24, 1978

INVENTOR(S) : Tsukasa NAGAO

It is certified that error appears in the above-identified patent and that said Letters Patent are hereby corrected as shown below:

On the title page, left-hand column, the Foreign Application Priority Data should appear as follows:

May 10, 1975[JP] Japan.....50-54922

Apr. 19, 1976[JP] Japan.....51-44760

Signed and Sealed this

*Second* Day of *January 1979*

[SEAL]

*Attest:*

RUTH C. MASON
*Attesting Officer*

DONALD W. BANNER
*Commissioner of Patents and Trademarks*